United States Patent [19]

Chase

[11] 4,159,096

[45] Jun. 26, 1979

[54] SUPER STABLE, SIMPLY ASSEMBLEABLE TREE STAND

[75] Inventor: Ascher Chase, Virginia Beach, Va.

[73] Assignee: General Foam Plastics Corp., Norfolk, Va.

[21] Appl. No.: 796,419

[22] Filed: May 12, 1977

[51] Int. Cl.[2] ..... A47G 33/12

[52] U.S. Cl. ..... 248/523; 248/529; 248/188.7

[58] Field of Search ..... 248/519, 523, 529, 165, 248/188.7

[56] References Cited

U.S. PATENT DOCUMENTS

| | | | |
|---|---|---|---|
| 3,139,256 | 6/1964 | Dodds | 248/188.7 X |
| 3,186,561 | 6/1965 | Strassle | 248/188.7 X |
| 3,186,669 | 6/1965 | Buhrmaster | 248/188.7 X |
| 3,719,340 | 3/1973 | Norton | 248/529 X |
| 3,862,733 | 1/1975 | Sullivan | 248/529 |

FOREIGN PATENT DOCUMENTS

| | | | |
|---|---|---|---|
| 1033994 | 6/1966 | United Kingdom | 248/523 |

*Primary Examiner*—Lawrence J. Staab
*Attorney, Agent, or Firm*—Mandeville and Schweitzer

[57] ABSTRACT

A super stable, simply assembleable tree stand is provided for artificial Christmas trees and the like, which stand provides increased stability in relation to the load applied. The stand includes a central, disc-shaped hub portion which interlocks vertically and horizontally with a plurality of radiating, tapered legs, with the component parts so configured that, when interlocked, they cannot be separated under load, or loosen or "wobble" with respect to each other. The component parts are comprised of substantially rigid thermoplastic resin material with a slight degree of resiliency, such as high impact polystyrene, so as to provide a gripping action between the parts when they are joined. The legs are connected to the hub portion with a tongue and groove arrangement connectable from the bottom of the stand upwardly, so that applied loads from above serve to urge the tongue and groove joints into a fully seated and totally stable condition.

10 Claims, 7 Drawing Figures

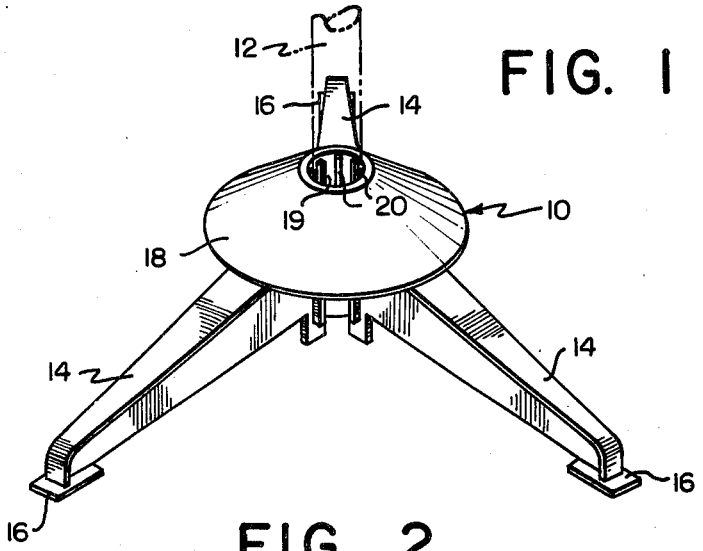
FIG. 1
FIG. 2
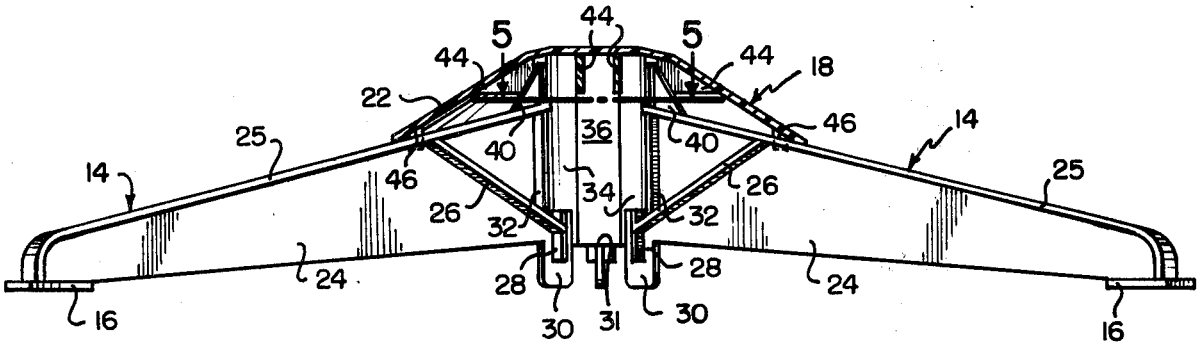
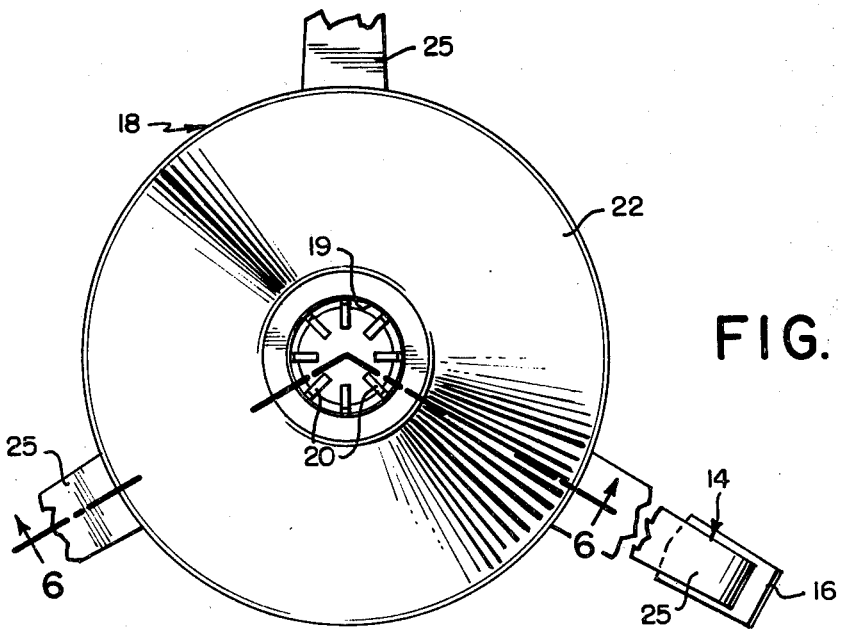
FIG. 3

SUPER STABLE, SIMPLY ASSEMBLEABLE TREE STAND

BACKGROUND AND STATEMENT OF THE INVENTION

A very strong, a very stable, and simple to assemble tree stand is provided for artificial Christmas trees and the like, which stand is so configured that it increases its stability in relation to the load applied to the stand in the form of a tree and decorations. The stand includes a central hub or conical disc-shaped body portion which is mated together with three legs to form a tripod-type stand. The central body portion and the tapered legs include cooperative tongue and groove attachments for joining the legs to the central body portion along vertical axes of the assembly, and the body portion further includes spaced locking pins to embrace the top edges of the legs along generally horizontal axes of the assembly.

The tapered legs of the invention are of substantial length in relation to the height of the stand to further increase stability, and the legs include substantial web and flange portions which impart a substantial degree of strength, as well as some flexion, to the stand assembly itself. The innermost lower portions of each leg include integral ground engaging abutments or feet, which are disposed slightly above ground level when the stand is unloaded and which feet engage the ground under load when a tree trunk is placed in the socket of the hub. Thus, the stand of the invention increases in stability by contact of the central feet with the ground when a load is applied thereto. The stand of the invention is, therefore, extremely stable and extraordinarily strong; indeed, in the general dimensions useful for a two to eight foot tree, e.g., approximately 12 inch long legs, it will support the weight of an adult person.

The vertical tongue and groove connections between the hub and the legs are established from the underside of the hub upwardly. Moreover, the disc-like hub portion includes a depending skirt with the outer edges thereof engaging the upper flanged edges of each of the tapered legs, to force the tongue and groove connections into positive, full seated engagement under load. The skirt includes the aforementioned pairs of locking pins for engaging each side edge of the top flanges of each leg, as well, to prevent lateral displacement of the legs in relation to the central body portion. Thus, the stand is both horizontally and vertically stabilized to prevent wobbling.

Before describing the invention in greater detail, it should be noted that the components of the new stand are comprised of a substantially rigid material having a degree of resiliency so as to enhance the interlocking frictional engagement between the several parts thereof. Preferably, the parts are comprised of injection molded high impact polystyrene with appropriate plasticizers added, in order to impart the degree of resiliency desired. Moreover, as will be appreciated, color may be added to enhance the decorative effect of the stand, e.g., the components may be green and/or red.

Other objects and advantages of this invention will be apparent from the following description, the accompanying drawings, and the appended claims.

DESCRIPTION OF THE DRAWINGS

FIG. 1 is a perspective view, illustrating a preferred embodiment of the invention;

FIG. 2 is an enlarged side elevational view of the stand of FIG. 1, with portions broken away to show the interconnection between the parts thereof;

FIG. 3 is an enlarged top plan view of the stand of FIG. 1;

DETAILED DESCRIPTION OF A PERFERRED EMBODIMENT

Figure 4:
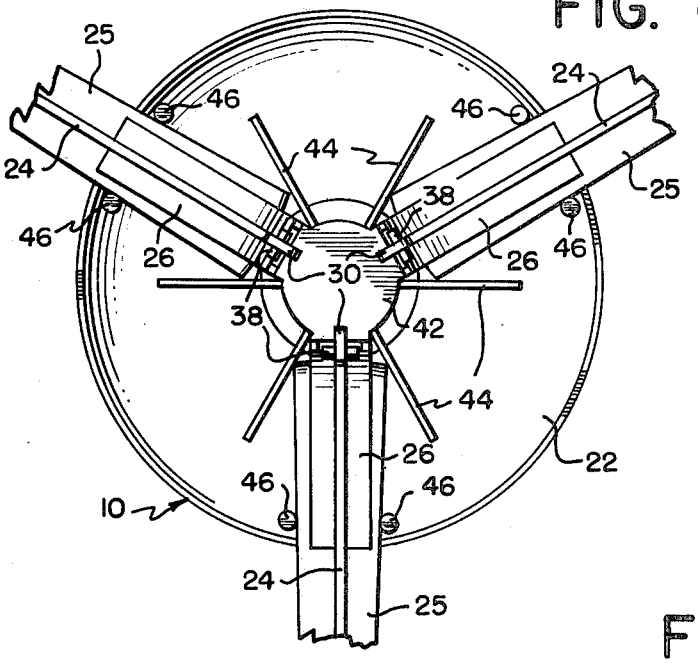
FIG. 4 is an enlarged bottom plan view of the stand of FIG. 1.
Figure 7:
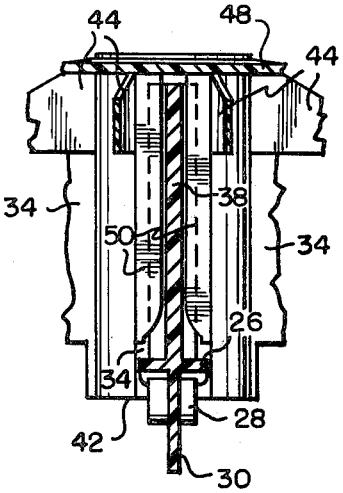
FIG. 7 is a cross section taken along line 7—7 of FIG. 5.

Referring to the drawings in which like reference characters refer to like parts throughout the several views thereof, a new and improved super stable, simply assembleable tree stand generally designated 10 is shown in FIG. 1. The stand 10 comprises a central hub or body portion 18, having a closed cylindrical socket 19 for receiving a tree trunk 12, shown in phantom lines, and a plurality of laterally extending tapered legs 14 with floor-engaging, horizontal pads 16 at the ends thereof. The socket 19 includes a plurality of circumferentially spaced, semi-resilient, tapered ribs 20. In this connection, because ribs 20 are integral with the hub 18, are comprised of a semi-resilient material, and are wider at the bottom of the socket than at the top, they serve to grip and to support the trunk of a tree inserted into the socket 19 by a force fit, as will be understood.

Referring now to FIG. 2, each tapered leg 14 includes a generally triangular web portion 24 having its inclined upper edges joined integrally with a top flange 25, as shown. Inclined inwardly from the top flange 25 is an additional integral diagonal brace or flange 26 extending toward inner vertical feet 30. In this connection, the lower surfaces 31 of the feet 30 are elevated slightly above the ground and the plane of the pads 16 when the stand assembly of the invention is not under load. However, and in accordance with the invention, when a load is placed on the central body portion 18 by a tree, and if the weight of the tree is sufficient, the surfaces 31 are forced downwardly into contact with the ground. Thus, the stability of the stand is enhanced by the slight flexing action of legs 14 under load to accommodate the depression of the feet 30 into the plane of the pads 16.

As shown in FIG. 2, the central hub body 18 includes a truncated conical skirt or disc 22, having an inner surface which extends downwardly and engages at its periphery with the upper flanges 25 of each of legs 14. Integral with the inner surface of the disc 22 are a plurality of pairs of circumferentially spaced locking pins 46, which engage each side of the top flange 25 of each leg 14 in the assembled arrangement of the stand, to prevent displacement of the legs in relation to the body portion. Also, the inner surface of disc 22 includes a plurality of circumferentially spaced integral vertical webs 44, which serve to brace and to strengthen the disc 22.

Figure 6:
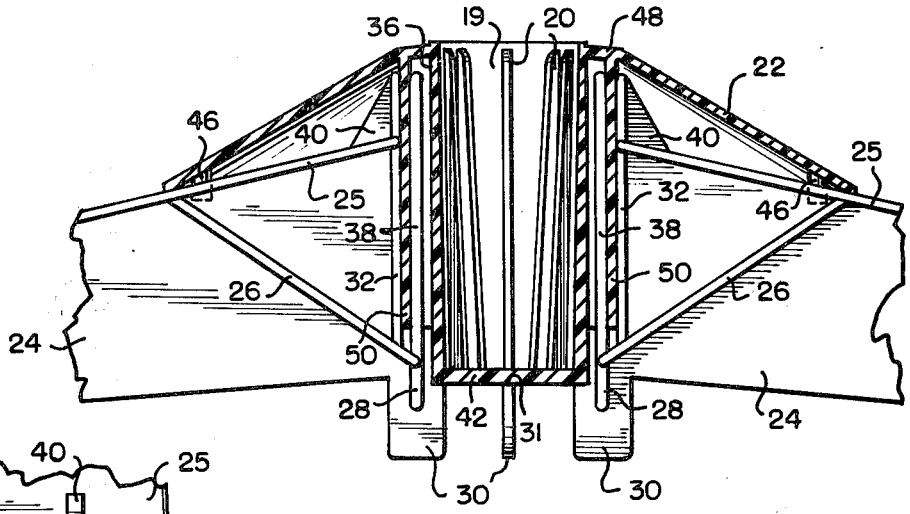
FIG. 6 is a cross section taken along line 6—6 of FIG. 3, further enlarged.

As shown in FIG. 6, the hub body 18 includes a central tubular portion 36 with a bottom wall 42 which is seated on horizontal upper surfaces 31*a* of the feet 30. Extending radially outwardly from the tube 36 at the upper edge thereof is a generally horizontal flange portion 48. Depending from flange 48 along the vertical surface of the body 36 are a plurality of pairs of circumferentially spaced channel members 34 (FIG. 5), with each channel 34 including opposed tongues 50.

Figure 5:
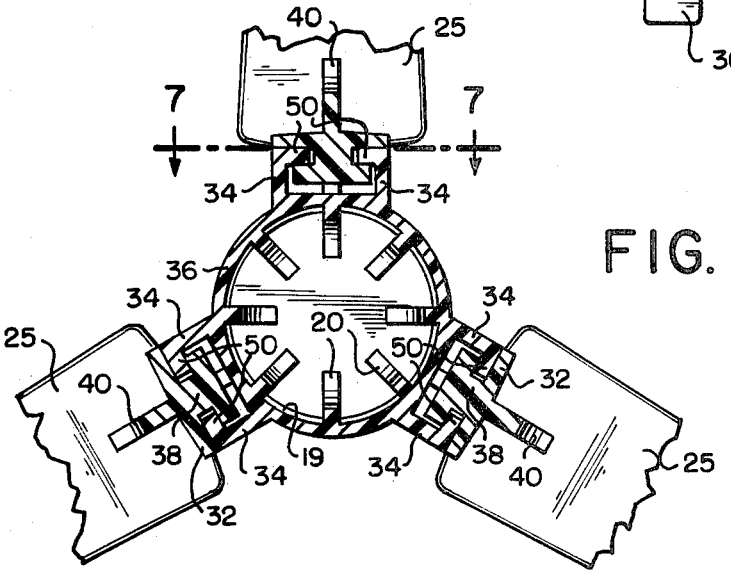
FIG. 5 is a cross-sectional view taken along line 5—5 of FIG. 2.

Each of the inner ends of the legs includes vertical flanges 32, 38 which cooperate to form grooves 51 to receive and mate with the tongues 50, for holding the individual legs firmly engaged on the central body portion 18. This cooperating engagement between the parts to form the multiple tongue and groove connections can readily be seen in FIG. 5. As shown in FIG. 5, six such circumferentially spaced connections are provided.

Extraordinary stability is achieved with the new stand because of the large number of areas of and the nature of the engagement between the cooperating components of the stand. For example, as noted above, the pins 46 depending from disc 22 of central body portion 18 are positioned to engage each side edge of the upper flange 25 of each leg 14 to prevent lateral movement of the legs on the central body portion. In addition, the dual tongue and groove connections between each of the legs and the hub also prevents relative movement between the legs and the central body portion. Moreover, the tongue and groove connections, because of the insertion of the tongues from below into the cooperating grooves of the legs, tend to become further seated and better established by the load on the stand. Indeed, such increases in load cause a slight degree of flexing of the legs, causing a slight lowering or depression of the central body portion. Ultimately, this causes the feet 30 centrally disposed under the central body portion to bottom on the ground upon which the stand is resting under load. Finally, because of the length of the legs 14 in relation to the vertical height of the stand, the stand has an extremely low center of gravity in relation to the diameter of the stand, including the lateral extent of the legs thereof.

Therefore, when a tree trunk is inserted into the socket 19 of the stand, and the lower end of the trunk is engaged by and gripped by the spaced, tapered, resilient ribs 20, the stand will not turn over or wobble, and it will increase in stability in relation to the load added. Moreover, the use of the ribs in the hub socket (whether tapered or straight) allows for some imperfections in the bottom portions of the inserted tree pole, since the ribs can "stretch" or indent into the pole. Tolerances are, therefore, less critical. In addition, many internal hub diameters and/or socket shapes may be created with very inexpensive mold variations and subsequent reduction in tooling costs. Furthermore, it may be desired to taper the lowermost portion of the inserted (usually generally cylindrical) tree trunk to taper congruently with or to be otherwise congruent or lightly matable with the socket 19. When this is done, the stability of the resulting tree and stand is still further enhanced, as will be understood.

While the form of tree stand assembly herein described constitutes a preferred embodiment of the invention, it is to be understood that the invention is not limited to this specific form of tree stand, and that changes may be made therein within the scope of the invention, which is defined in the appended claims. For example, as noted above, a greater number of legs may be used in the stand, and/or the cooperating elements of the tongue and groove connections may be reversed on the legs and central body portion. Similarly, the skirt portions, which are shown to be conical, may have other shapes which function with the same efficacy as the illustrated truncated conical discs.

I claim:

1. A tree stand assembly comprising (a) a one-piece molded central hub means including

1. a central tubular socket means having a generally horizontal bottom;

2. a conical skirt means extending outwardly and downwardly from the uppermost portions of said socket means;

3. vertically extending leg coupling means integrally formed on the outer surfaces of said socket means;

4. locking pin means integrally formed at peripheral edges of the underside of said skirt means and aligned radially with each of said leg coupling means; and (b) a plurality of one-piece molded horizontally extending leg means

1. each of said leg means including pad means at the distal ends thereof and including vertically extending feet means at the inner ends thereof;

2. hub coupling means formed integrally on the uppermost inner edges of said leg means and adapted to be firmly matable with said aforementioned leg coupling means;

3. the uppermost edges of said leg means being adapted to be engaged with said locking pin means when said coupling means are fully engaged in a manner whereby said leg means and said central hub means may be readily and quickly assembled into a rigid and stable artificial tree supporting unit;

4. said vertically extending feet means having horizontal surfaces adapted to engage with and support the bottom of said tubular socket means.

2. The tree stand assembly of claim 1, in which said leg coupling means and said hub coupling means are in the form of tongue and groove connectors integrally formed on said hub means and said leg means.

3. The tree stand assembly of claim 1, in which said socket means are provided with integral internal tapered rib means adapted to engage an artificial tree trunk.

4. In a tree stand of molded resin material, comprising (a) a body;

(b) a vertically extending, tree trunk receiving aperture formed in the center of said body and having a generally horizontal bottom;

(c) a plurality of supporting legs extending substantially horizontally from said body; the improvement characterized by (d) cooperating tongue-in-groove connections between said body and each of said legs;

(e) and integral conical skirt on the upper periphery of said body, said skirt depending downwardly and outwardly from said aperture;

(f) the outer circumferential edge of said skirt engaging the top surface of each said leg; and (g) an integral ground engaging abutment on each said leg at the end thereof adjacent said body and having a horizontal upper surface;

(h) the bottom surface of each said abutment spaced above the supporting surface of said stand when said stand is not under load;

(i) said upper surface of each said abutment engaging said horizontal bottom.

5. The stand of claim 4, further characterized by (a) a plurality of integral parallel vertical ribs circumferentially spaced around said aperture.

6. The stand of claim 4, with each said leg further characterized by (a) a web portion with an upper surface inclined downwardly from adjacent said body to the outer end thereof;

(b) an upper flange integral with said upper surface; and (c) said outer surface of said skirt engaging said upper flange.

7. The stand of claim 4, further characterized by (a) the engaging surfaces of said cooperating tongue-in-groove connections being vertical and engagable from the bottom of said stand.

8. The stand of claim 4, further characterized by (a) a plurality of pairs of integral leg engaging pins spaced circumferentially around the bottom surface of said skirt adjacent the outer edge thereof for engaging the side edges of each said leg.

9. The stand of claim 4, further characterized by (a) three supporting legs connected to said body.

10. The stand of claim 4, further characterized by (a) said stand comprised of injection molded polystyrene.

* * * * *